United States Patent [19]

Rodriguez

[11] Patent Number: 4,672,867

[45] Date of Patent: Jun. 16, 1987

[54] FLEXPLATE TURNING TOOL

[75] Inventor: Saulo Rodriguez, McAllen, Tex.

[73] Assignee: Lisle Corporation, Clarina, Iowa

[21] Appl. No.: 762,638

[22] Filed: Aug. 5, 1985

[51] Int. Cl.[4] ..... B25B 13/48; B25B 7/02

[52] U.S. Cl. ..... 81/176.1; 81/176.2; 81/423

[58] Field of Search ..... 81/176.1, 176.3, 176.2, 81/176.15, 418–426.5; 269/277, 280, 282, 134, 137, 259, 268, 261, 262, 209

[56] References Cited

U.S. PATENT DOCUMENTS

| | | | |
|---|---|---|---|
| 1,174,132 | 3/1916 | Dragun | 81/424 |
| 1,579,992 | 11/1924 | Altman | 81/176.15 |
| 2,531,039 | 11/1950 | Hardie | 81/178 |

FOREIGN PATENT DOCUMENTS

| | | | |
|---|---|---|---|
| 255060 | 1/1912 | Fed. Rep. of Germany | 269/282 |

*Primary Examiner*—Frederick R. Schmidt
*Assistant Examiner*—Maurina Rachuba
*Attorney, Agent, or Firm*—Allegretti, Newitt, Witcoff & McAndrews, Ltd.

[57] ABSTRACT

A wrench tool includes a plate defining a handle at one end with a manual grip and a mounting surface for opposed, pivotal gripping jaws at its opposite end.

3 Claims, 6 Drawing Figures

FLEXPLATE TURNING TOOL

BACKGROUND OF THE INVENTION

This invention relates to an improved automotive tool and more particularly to a flexplate turning tool also referred to as wrench or flexplate wrench.

With the advent of smaller sized automobiles and the incorporation of front wheel drive for such automobiles, the engine compartment of automobiles has become much more crowded with engine components and other parts of the automobile. Engines have been modified and refined in order to maximize the use of space within the engine compartment. An outgrowth of this effort has been the development of a new design for flexplates in typical internal combustion engines for front wheel drive automobiles. Such flexplates are thin disc-shaped plates with a peripheral gear protected by an appropriate cover to provide very limited access to the flexplate for removal and repair. Gripping the flexplate plate with a tool and rotating or pivoting that plate particularly in the inaccessible engine compartment of newer automobiles is quite difficult. As a result, traditional wrenches, spanners and other automotive tools are of limited use for removing or rotating flexplates during automotive repair.

SUMMARY OF THE INVENTION

Thus, it is an object of the present invention to provide an improved tool especially useful for gripping and moving a flanged or ribbed disc such as a flexplate.

Yet another object of the invention is to provide an improved tool of simplified construction which may be utilized to grip a peripheral rib of a disc regardless of the dimension of the peripheral rib.

Still a further object of the present invention is to provide an inexpensive, rugged and serviceable wrench-type tool useful for engagement with and turning a flexplate of the type having a peripheral rib.

In order to accomplish these and other objectives, the wrench tool of the present invention includes an elongate member having a handle and wrench end. First and second reversible gripping jaws, attached on the wrench end, are spaced to define a slot or passage for receipt of a portion of a peripheral rib associated with a flexplate or similar engine component. The spaced gripping jaws both project from the same side of the wrench end and are spaced a distance slightly greater than the width of the peripheral rib that is to be gripped in order that the jaws may thereby engage against the rib and permit gripping and rotation of the entire flexplate disc. The configuration of the jaw surfaces as well as their spacing may be modified to accommodate various sized ribs on a disc or plate.

The described embodiment as well as other embodiments, objects, advantages and features of the invention will be understood more clearly by reference to the following written description.

BRIEF DESCRIPTION OF THE DRAWING

In the detailed description which follows, reference will be made to the drawing comprised of the following figures.

DESCRIPTION OF THE PREFERRED EMBODIMENT

Figure 6:
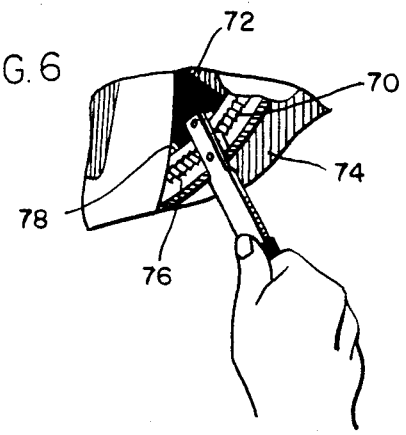
FIG. 6 is a perspective view illustrating the manner in which the tool of the invention is used.
Figure 1:
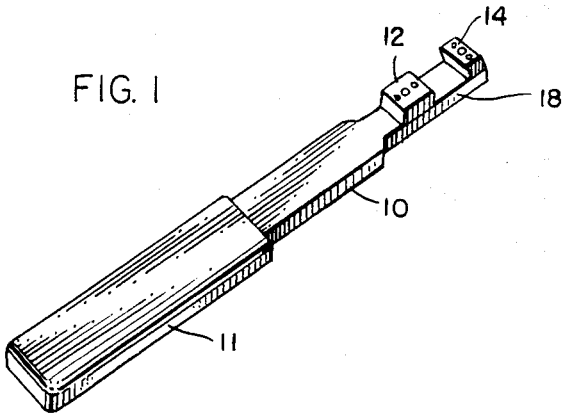
FIG. 1 is a perspective view of the improved tool of the present invention.
Figure 2:
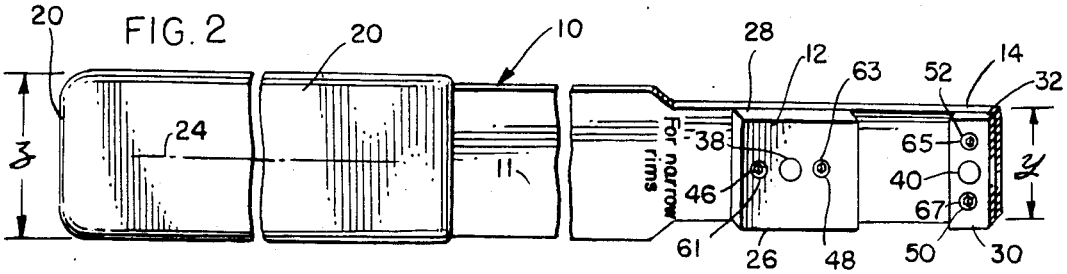
FIG. 2 is a plan view of the tool of FIG. 1.

The improved wrench tool of the present invention is comprised of a unitary, elongated handle and support plate 10 which is cooperative with first and second jaws 12 and 14 respectively. The specific configuration and assembly of the plate 10 as well as the jaws 12 and 14 results in the combination of features that define the invention.

Referring therefore to the figures, the plate 10 is defined by a generally elongated handle section 11 and a wrench end 18. The handle section 11 has opposed spaced side surfaces 15 and 16 which are generally planar and parallel to one another. The side surfaces 15 and 16 extend to the transverse end surface 22 of the tool. The handle section 11 is sufficiently long for manual gripping of the tool and preferably includes a protective plastic or rubber grip 20. The wrench end 18 is also generally a rectangular parallelpiped and terminates with the flat planar surface 22 that is transverse to a longitudinal axis 24 of the tool. Thus, the plate 10 is a generally straight member having a longitudinal axis 24.

Wrench end 18 has a width, y, which is less than the width, z, of the handle section 12 though this is an optional feature of the invention. The width, y, is dependent, in part upon the dimension of the flange, rib or rim on which the tool is to be used. That is, the tool is designed for gripping an arcuate rib. As the radius of the arc of the rib which is to be gripped decreases, so does the width, y. For example, if the radius of the rib is about 6″, then the width, y, is preferably about $\frac{3}{4}$″ to 1″. The ratio of rib radius to tool width is preferably in the range of 10:1 to 5:1, though variations from these ratios are possible.

Attached to the top planar surface 15 of the tool are the first and second jaws 12 and 14 respectively. Jaw 12 is defined as a generally rectangular block having spaced, side surfaces 26 and 28. Surfaces 26 and 28 define a width, y, of the jaw 12 substantially equal to the width, y, of the wrench end 18 of the tool. In like manner, the second jaw 14 includes the side surfaces 30 and 32 which are spaced substantially the width, y, of the spacing of surfaces 26 and 28 as well as the width of the wrench end 18. The surfaces 26, 28, 30, and 32 are thus parallel. Surfaces 26 and 30 are coplanar as are surfaces 28 and 32.

Figure 3:
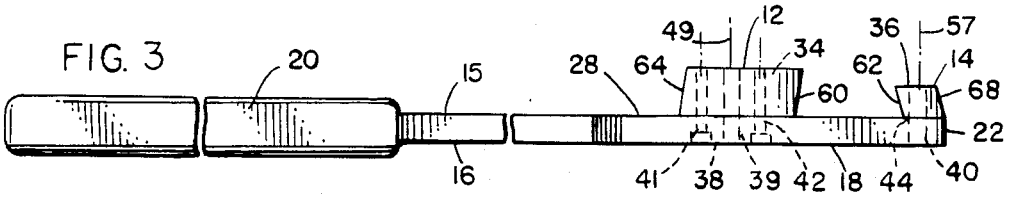
FIG. 3 is a side elevation of the tool of FIG. 2.
Figure 4:
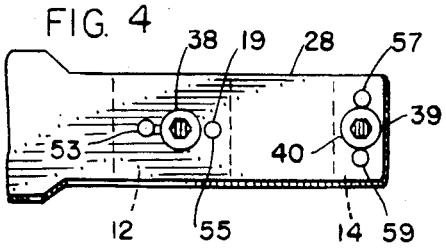
FIG. 4 is an enlarged back or bottom elevation of the end of the tool shown in FIG. 3.

The jaws 12 and 14 are of substantially unequal thickness and include planar top surfaces 34, 36 spaced from the surface defined by side 15. Thus, as shown in FIG. 3, the top surface 34 of the jaw 12 is about two times the distance from side 15 as is the surface 36 of jaw 14 when the tool is in the assembled condition. The reason for this construction will be apparent upon a review of the following description.

The jaws 12 and 14 are each mounted by means of a machine bolts 38 and 40 respectively onto the end 18 of the tool. The machine bolts 38 and 40 each include a head 39 and shank 41. The head 39 is received in a counter bore of the respective passage 42 and 44 in the end 18, and the shank 40 is threadably engaged with the appropriate block 12 or 14. In this manner the blocks 12 and 14 are retained in position on wrench end 18, and the head 39 is retained in the end 18 where it is not exposed to interfere or catch on a housing, for example.

Each block also includes a first and second guide pin 46 and 48 respectively for block 12, and 50 and 52 respectively for block 14. The guide pins 46, 48, 50 and 52 extend through passages 61, 63, 65, 67 provided in the blocks 12 and 14 into associated passages 53, 55, 57, 59 defined in the end 18. Note that the pins 46 and 48 define vertical axes as depicted in FIG. 3 which lie along the same plane as the vertical axis 49 of the retention bolt 38. In a similar fashion, the vertical axis of the pins 50 and 52 lie in the same plane and define the plane in which the axis 51 of the fastening bolt 40 will lie. In this manner, the blocks 12 and 14 respectively may be inverted or reversed by removing the bolts 38 and 40 and inverting the blocks 12, 14 as well as the pins 46, 48, 50, 52 to thereby alter the arrangement of the blocks 12 and 14 on the end 18 of the wrench. This feature of block inversion permits the jaws 12 and 14 to be inverted. As a result, surfaces 64 and 68 may be positioned in opposed relation rather than surfaces 60, 62. Jaw 12 is thus inverted to alter the spacing between the jaws. Jaw 14 is inverted merely to substitute active gripping surface 62 for surface 68 or vice versa. This results since the bolt 40 is symmetrically positioned in block 14. Bolt 39 is asymmetrically positioned thereby enabling a change in spacing if the jaw block 12 is inverted.

In review, block 12 may be inverted to expose surface 60 or surface 64 in opposed relationship to a surface of jaw 14. Likewise, the jaw 14 may be inverted to expose either surface 62 or surface 68 to the opposed surface of jaw 12. In this manner it is possible to obtain at least two variable spacings between the jaws 12 and 14. The surfaces 60, 62, 64 and 68 are generally inclined with respect to the axis 24 and plane of side 15. The inclination is chosen and adjusted for purposes of compatibility with the part being worked upon by the tool.

Two pins 46 and 48 are disclosed for jaw 12 for alignment and inversion of the jaw 12 on the end 18 of the tool. It is possible, however, to eliminate one of the pins and still maintain the inversion feature so long as compatible openings are provided within the end 18 of the wrench. Additionally, it is possible to provide further openings defined in the end of the wrench 18, eg. opening 19 to effectively skew the surfaces of block 12 or 14, for example. Thus, the surfaces, for example surfaces 60 and 62, may be arranged at a skewed angle with respect to the axis 24 depending upon the arrangement of the cooperative passages or openings for the pins 46 and/or 48.

Figure 5:
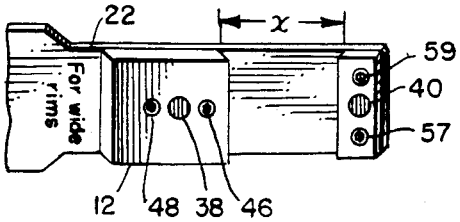
FIG. 5 is a top plan view of the end of the tool wherein the jaw blocks have been pivoted or moved to alter the spacing between the jaw block spaces.

FIG. 5 illustrates further the manner by which the space, x, between the jaws 12 and 14 may be adjusted in accordance with the manner in which the jaws 12 and 14 are inverted. The need for adjustment of the space "x" between the jaws will become apparent by reference to FIG. 6 wherein the utility of the tool is demonstrated.

Referring to FIG. 6, the jaws 12, 14 are set at a particular spacing "x" which is slightly greater than the width of a peripheral rib or flange such as rib 70 in FIG. 6 of an associated flexplate 72 mounted within an engine 74. Thus the rib 70 includes opposed generally parallel surfaces 76 and 78 which are engaged, at least in part, by opposed surfaces, for example surfaces 60 and 62, of the tool. As these opposed surfaces 60, 62 interrelate with rib 70 by virtue of manual pressure, it is possible to manually translate or rotate the flexplate 72 about its axis due. Force is placed through the handle 20 of the tool to turn the flexplate 72 about its axis.

Jaw 12, being thicker than jaw 14 is positioned along the outside rim of flexplate 72. Jaw 14 is thinner than jaw 12 in order to accommodate the center of the flexplate 72. Thus, the tool fits tightly against the rib 70 and defines a generally radial extension of the flexplate 72.

It is possible to vary the construction of the tool and still be within the scope and spirit of the invention. For example, the particular means for mounting the jaws 12, 14 on the end 18 of the tool may be varied. The shape and size of the jaws 12 and 14 may be varied. The angle of inclination of the various surfaces of jaws 12, 14 may be varied to accommodate needs. The shape and configuration of the handle 12 may be varied. The relative dimensions of the handle may be varied as may the relative dimensions of the end 18. The number and placement of the pins, eg. 46, 48 and bolts, eg. 38, 40 may be varied. Thus, while there has been set forth a preferred embodiment of the invention, it is to be understood that the invention is to be limited only by the following claims and their equivalents.

What is claimed is:

1. A wrench tool for gripping a limited access disc such as a flexplate of the type having an arcuate, raised rib adjacent at least a portion of the circumference thereof, said rib having radially spaced arcuate surfaces, said tool comprising, in combination:

an elongate handle extending to and integrally connected with an operating wrench end;

said handle and wrench end generally defining a unitary member;

said wrench end comprising a rectangular parallelepiped with a generally flat planar surface;

first and second gripping jaws mounted on the planar surface of the wrench end and fastened thereto in opposed spaced relation, said first gripping jaw comprising a generally rectangular parallelepiped block, said first jaw attached on one side of the planar surface at the distal end of the wrench end;

said second gripping jaw also comprising a generally rectangular parallelepiped block, said second jaw also attached on the same one side of the planar surface, coplanar with the first jaw and spaced from the first jaw to define a gap, said gap having a generally uniform width slightly greater than the width of the arcuate rib which is to be gripped by the tool and defined by spaced, generally opposed, generally planar jaw side surfaces with edges for engagement with the arcuate surfaces of the arcuate rib, said planar side surfaces being inclined relative to the planar surface of the wrench end; and fastening means for attaching one of said jaws to the planar surface on the wrench end, said one jaw having at least two side surfaces, one of the side surfaces being retained by the fastening means in opposed relation to the side surface of the other jaw to thereby define the dimension of the gap, said one jaw being pivotal to position the other side surface of said one jaw to redefine the dimension of the gap, said fastening means asymmetrically mounting said jaw whereby pivoting of said jaw to alter the choice of side surface defining the gap will effect a change in the dimension of the gap.

2. The tool of claim 1 wherein the opposed side surfaces are inclined relative to each other and to the plane of the planar surface on which the jaws are mounted.

3. The tool of claim 1 wherein said second jaw has a thickness measured from the planar surface of the wrench end approximately two times the corresponding thickness of the first jaw.

* * * * *